US005904158A

United States Patent [19]

Mitchell et al.

[11] Patent Number: 5,904,158

[45] Date of Patent: May 18, 1999

[54] THERMO RESPONSIVE METHOD OF REMOVING CURED PAINT

[75] Inventors: David B. Mitchell, Yardley, Pa.; Ralph L. Minnis, Des Plaines, Ill.; Gene V. Wayman, Fox River Grove, Ill.; Steven M. DeBoo, Lake Zurich, Ill.; Mark J. Deschryver, Doylestown, Pa.

[73] Assignee: BetzDearborn Inc., Trevose, Pa.

[21] Appl. No.: 08/954,949

[22] Filed: Oct. 22, 1997

[51] Int. Cl.[6] ..... B08B 7/00

[52] U.S. Cl. ..... 134/4; 134/17; 134/19; 134/38

[58] Field of Search ..... 134/4, 17, 19, 134/35, 38

[56] References Cited

U.S. PATENT DOCUMENTS

| | | | |
|---|---|---|---|
| 4,554,025 | 11/1985 | Burke et al. . | |
| 4,705,574 | 11/1987 | Burckhardt et al. . | |
| 4,844,833 | 7/1989 | Komatsu et al. . | |
| 4,867,900 | 9/1989 | Komatsu et al. . | |
| 5,017,303 | 5/1991 | Komatsu et al. . | |
| 5,132,054 | 7/1992 | Stahl . | |
| 5,186,978 | 2/1993 | Woodhall et al. | 427/154 |
| 5,494,702 | 2/1996 | Blaine et al. | 427/154 |

*Primary Examiner*—Jeffrey Snay
*Attorney, Agent, or Firm*—Steven D. Boyd

[57] ABSTRACT

A method of removing layers of heat cured paint buildup on supporting hangers is disclosed. The method includes coating support hangers with a layer of a thermally expandable material in a water soluble carrier and thereafter applying a water insoluble coating layer. The thermally expandable material, the carrier and the water insoluble coating are all selected so as to be relatively unaffected by the curing temperatures of the paint line where the hangers are to be used. When an undesirably thick coating of cured paint has built-up on the hangers, it is removed by heating to a temperature sufficient to expand the thermally expandable material thereby cracking the paint layers. Thereafter, the hangers are soaked in a hot aqueous solution to dissolve the carrier layer and remove the cracked, cured paint layers.

5 Claims, No Drawings

THERMO RESPONSIVE METHOD OF REMOVING CURED PAINT

FIELD OF THE INVENTION

The present invention relates to an improvement in a process for removal of built up layers of cured paint.

BACKGROUND OF THE INVENTION

Removing cured paint coatings from large volumes of racks, hangers or other paint line equipment has been a problem for production finishers. Heavy buildups of paint can flake off onto the work piece and prevent a fixture from working properly, and even light buildup can interfere with the quality of an electrostatic painting process.

Several techniques have been developed in attempts to satisfactorily remove paint coatings on such equipment. One such technique is to debond or dissolve the organic coating in an chemical solvent bath. Such solvents include methylene chloride and trichloroethane. While these solvents are often effective for debonding the paint coating from the substrate, they generate chemical waste such as stripping sludges, which result in disposal and pollution problems. Additionally, long soaking times are often required, which makes this method undesirable for continuous on-line operations.

Another technique involves applying a liquefied inert gas to the support and/or to the built-up paint layers to cause embrittlement of the paint and lessen the bond between the support and the built-up paint layers. The paint layers while still under cryogenic conditions are removed from the support by impact or blasting. The impact can be by abrasive particles which are blasted at the surface by air or mechanical means, or may be a simple mechanical impact. Repeated use of such abrasive particles or impacts tends to wear down or deform the hangers, especially where the hangers contain screws, springs or similar objects. See for example U.S. Pat. Nos. 4,554,025 and 4,705,574.

In a further technique for removing unwanted paint layers from racks, hangers, etc., a coating is formed on the hangers prior to their use in painting operations. The coating has minute bubbles on the surface. After accumulation of paint over the coating a mechanical impact to the hanger forms a gaseous layer between the hanger and the paint layers. Thereafter, the paint layers are peeled from the hanger by mechanical means. See for example U.S. Pat. No. 4,867,900.

In U.S. Pat. Nos. 5,017,303 and 4,844,833 a paint peeling composition and method for removing uncured paint from an object is disclosed. The method involves coating an object, such as floor grates in a paint spray booth, with a water soluble polyvinyl alcohol, polyvinyl acetate, or acrylic resin layer which incorporates thermally expandable microballoons. Unnecessary paint is removed from the objects by immersion in hot water. The hot water expands the thermally expandable microballoons and dissolves or disperses the carrier layer thereby removing the paint.

BRIEF SUMMARY OF THE INVENTION

The present invention relates to improvements in a process for removing layers of heat cured paint buildup on supporting hangers, carriers etc. in a paint finishing operation. In a heat cured painting process an object to be painted is attached to a hanger or carrier which carriers the object through a water-based cleaning operation, a paint spray booth operation and a heat curing oven. The object is then removed from the carrier and the carrier is reused. As layer after layer of cured paint builds up on the carrier, its operation can be adversely affected.

The present invention comprises a method of treating such hangers or carriers prior to use which makes removal of the cured paint layers much easier. The method includes coating the hangers or carriers with a thermally expandable material in a suitable water soluble carrier and thereafter applying a water insoluble coating. The thermally expandable material, the carrier and the water insoluble coating are all selected so as to be relatively unaffected by the curing temperatures of the paint line where the hangers are to be used. The thermally expandable material is selected so as to have an expansion temperature above the highest temperature encountered in the paint curing operation.

When the cured paint buildup on the hangers begins to adversely effect the painting operation, the layers of cured paint are removed by the following process. The coated hangers having unwanted layers of cured paint thereon are exposed to heat sufficient to expand the thermally expandable material in the resin layer. This expansion fractures the water resistant coating layer, as well as the unwanted cured paint layers. The hangers are thereafter exposed to a hot aqueous wash which dissolves the carrier layer through the fractures, dissolution of the carrier layer removes the cracked, cured paint layers. The hangers are then retreated with the thermally expandable material in a carrier and the water insoluble layer so as to be ready for reuse.

The method of the present invention avoids the use of solvents to dissolve the paint layers or mechanical impact on paint layers for removal. The methods of the present invention quickly and efficiently remove cured paint layers with the use of a heating operation and a, aqueous wash. The process of the present invention is effective in treatment of hangers used in painting processes which include an water-based washing or rinse step, painting, and heat curing.

DETAILED DESCRIPTION OF THE INVENTION

The present invention is an improved process for removing built up layers of cured paint or similar organic coatings from support devices (hangers) in product finishing operations. The hangers employed in such operations vary widely with the type of product being treated and often have complex geometries. A typical example would be 1/16 to ½ inch (16 mm to 128 mm) diameter steel rods, although much smaller and larger supports are common. The hangers can be steel, aluminum, plastics or any other material suitable to support the object being painted under the conditions of the painting process.

Objects to be painted are attached to the hanger which conveys the objects through the painting process. The painting process typically involves an alkaline water wash to clean the object, application of one or more layers of paint by spraying, dipping or electrostatic painting, and heat curing of the paint layers. The painted objects are removed from the hangers and the hangers are reused.

In accordance with the present invention, prior to attaching an object to a clean hanger, the hanger is pretreated with two coating layers. The first coating layer comprises a water-soluble carrier incorporating a thermally expandable material. The second coating layer comprises a water insoluble layer which is resistant to the paint process environments, i.e., the washing, painting and paint curing operations.

The water soluble carrier material of the first coating layer is preferably made up of an alkaline water-soluble film former, along with suitable binders, dispersing aids, plasticizers, mold release agents, and additives such as corrosion inhibitors, antifoaming agents and thickening agents. The film former of the first layer, by way of example, can be an acrylic resin, a polyvinyl acetate, polyacrylamide, or a polyvinyl alcohol. Preferred film formers in accordance with the present invention are acrylic dispersion resins in combination with vinyl acrylic emulsion binders and anionic polyacrylamide film formers.

Incorporated into the first coating is a thermally expansive material which has an expansion temperature higher than the maximum paint curing temperature to be encountered in the painting operation where the treated hangers will be employed. The expansion temperature is at least 30° F. and preferably at least 80° F. higher than the paint curing temperature which will be encountered. Typical paint curing temperatures can range from 100° to 210° F. to as high as 310° to 360° F. Based upon the paint curing temperature which the hangers will be exposed to, the material which will expand volumetrically at higher temperatures is selected. The thermally expandable material may comprise a foamed hollow matter such as microballoon/spheres filled with a gas, unfoamed hollow matter such as unfoamed latex synthetic resin balloons, or expandable graphite.

A preferred thermally expandable material for use on hangers which will be used in a painting operation having a paint cure temperature of from about 160° to 215° F. are microballoons/spheres having an exterior shell of polyvinyldiene chloride filled with isopentane. Such microballoons expand rapidly at 240° F. causing a 300 to 700% expansion of the resin coating. For painting operations having a paint cure temperature of from 260° to 380° F., a preferred thermally expandable material is flaked graphite. Flaked graphite is graphite which has been reacted at temperatures of from 100° to 130° C. with a strong oxidizing agent, such as sulfuric acid, nitric acid, or mixtures thereof. Flaked graphite begins to expand at about 370° F. (20% expansion) and continues to expand up to about 617° F. (1,140% expansion). Flaked graphite can be employed in high temperature painting operations where microballoons might decompose, and therefore are unacceptable.

The electrically conductive nature of expanded graphite makes it well suited to electrostatic painting operation where the hangers must be electrically conductive. In "low temperature" electrostatic painting operations where microballoon/spheres are suitable, the first layer may incorporate a minor amount of flaked graphite in order to render the coating electrically conductive.

The thermally expandable layer on the hangers is thereafter covered with a water-insoluble second layer to protect the first layer from any water-based wash or rinsing operations. This water-insoluble layer may be the water-based or solvent-based paint employed in the painting operation, or any other water-insoluble coating such as polyvinyl acetate, which is stable at the operating conditions of the painting operation where the hangers will be used.

The following examples will serve, without limitation, to illustrate the present invention.

EXAMPLE I

A water soluble first layer, incorporating thermally expanding microballoons, of the following formulation was prepared.

TABLE I

| Material | % (Weight) in Formulation |
|---|---|
| Deionized Water | 29.08 |
| Acrylic Dispersion Resin | 40.66 |
| Vinylacrylic Emulsion | 5.00 |
| Glycerin | 3.00 |
| Polyvinyldiene Microballoons Containing Isopentane | 15.00 |
| Modified Wax Mold Release | 2.50 |
| Hydrophobic Silica Antifoam | 0.15 |
| Plasticizer | 1.00 |
| Thickening Activators | 3.21 |

Fifteen hangers were treated by immersion in the above-described thermo expandable coating and dried at 160° F. After drying, they were sprayed with a high solids, solvent based, urethane-enamel paint which had a curing temperature of less than 200° F. and dried at 160° F. The painting operation where the hangers were used included an alkaline and an acid rinse with nonionic surfactants. The hangers were subjected to approximately 30 cycles of washing, spraying of a solvent based urethane enamel paint and heat curing at 200° F. The 30 coats of paint which built-up on the hangers was at least 30 mils thick.

The built-up paint layers were removed by placing the hangers in an oven at 300° F. for 25 minutes. The first coating layer expanded to 20–30 times its original volume and caused multiple cracks in the paint layers. The hangers were then placed in an alkaline water bath at 170° F. Within 15 minutes the hangers' surfaces were completely free and clean of any paint and protective coating. The hangers were then ready for retreatment in accordance with the present invention and reuse.

EXAMPLE II

A water-soluble first layer incorporating a flaked graphite thermally expandable material of the following formulation was prepared.

TABLE II

| Material | % (Weight) in Formulation |
|---|---|
| Deionized water | 36 |
| Expandable Flaked Graphite | 21 |
| Plasticizer | 6 |
| Foam Control Agent | 1 |
| Allied Colloid 86TX (a carboxylated acrylic copolymer emulsion) | 36 |

Hangers were treated by immersion in the above-described water soluble flaked graphite expandable coating and dried at 170° F. After drying, they were sprayed with a high solids, solvent based urethane-enamel paint which had a curing temperature of less than 200° F. and dried at 170° F. The hangers were employed in a painting operation which consisted of the electrostatic application of a solvent based urethane enamel and heat curing at 330° F. The treated hangers were conveyed through the paint line for 2–3 weeks and received 30–100 paint layers.

The built-up paint layers were removed by placing the hangers in an oven at 600° F. The expansion of the flake graphite layer cracked the paint layers. The hangers were then placed in an alkaline water bath at 170° F. The alkaline water bath dissolved the water-soluble first layer thereby removing the paint layers and protective coating. The hangers were then ready for retreatment in accordance with the present invention and reuse.

While the present invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What is claimed is:

1. A method of removing paint which has been cured at a first predetermined temperature range from the surfaces of an object comprising the sequential steps of:

(a) coating the object with a first layer of water-soluble material incorporating a thermally expandable material which expands in a second temperature range, said second temperature range being higher than said first predetermined temperature range;

(b) coating said first layer with a second, water-insoluble layer;

(c) thereafter exposing said object to one or more cycles of aqueous pretreatment, paint application and heat cure at said first predetermined temperature range whereby one or more layers of heat cured paint are formed on said water-insoluble layer;

(d) exposing said object to said second temperature range whereby said thermally expandable material expands thereby fracturing said water soluble material and said layers of heat cured paint; and (e) removing said fractured cured paint layers from said object by exposure to an aqueous solution.

2. The method of claim 1 wherein said second temperature range is 30° F. or more higher than said first predetermined temperature range.

3. The method of claim 1 wherein said aqueous solution is an alkaline aqueous solution.

4. The method of claim 1 wherein said thermally expandable material is selected from the group consisting of polyvinyldiene microballoons containing isopentone, expanded graphite and mixtures thereof.

5. The method of claim 1 wherein said water-insoluble layer is paint.

* * * * *